US005735064A

United States Patent [19]

Holl

[11] Patent Number: 5,735,064

[45] Date of Patent: Apr. 7, 1998

[54] OPERATIONAL CONTROL MECHANISM

[76] Inventor: Trygve A. Holl, 5509 Highwood Dr., Edina, Minn. 55436

[21] Appl. No.: 829,092

[22] Filed: Mar. 31, 1997

Related U.S. Application Data

[60] Provisional application No. 60/018,047 May 21, 1996.

[51] Int. Cl.[6] ..... E01H 5/09

[52] U.S. Cl. ..... 37/260; 37/257; 56/DIG. 18; 180/19.3

[58] Field of Search ..... 37/260, 257, 246, 37/244, 243, 249, 261, 262, 265, 285; 74/551.5, 554; 56/10.8, DIG. 18; 180/19.1, 19.2, 19.3; 16/111 R, 111 A, 110 R, 112, 113

[56] References Cited

U.S. PATENT DOCUMENTS

| | | | |
|---|---|---|---|
| 3,509,977 | 5/1970 | Bacon . | |
| 3,721,025 | 3/1973 | Orr . | |
| 3,774,322 | 11/1973 | Enters et al. . | |
| 3,808,715 | 5/1974 | Haban . | |
| 3,867,773 | 2/1975 | Gunderson . | |
| 3,879,866 | 4/1975 | Gunderson . | |
| 4,011,668 | 3/1977 | Gunderson . | |
| 4,068,397 | 1/1978 | Bacon . | |
| 4,185,403 | 1/1980 | Hardgrove | 37/265 |
| 4,212,363 | 7/1980 | Letner et al. | 180/19.1 X |
| 4,255,879 | 3/1981 | Greider | 37/245 |
| 4,294,027 | 10/1981 | Edwards | 37/259 |
| 4,346,526 | 8/1982 | Mattson et al. | 37/259 |
| 4,409,748 | 10/1983 | Westimayer | 37/261 |
| 4,694,594 | 9/1987 | Thorud et al. . | |
| 4,862,607 | 9/1989 | Wacker | 37/260 |
| 5,177,888 | 1/1993 | Thorud et al. . | |
| 5,315,771 | 5/1994 | White, III et al. . | |

*Primary Examiner*—Randolph A. Reese
*Assistant Examiner*—Thomas A. Beach

[57] ABSTRACT

A handle slide control for a push implement that includes a cable running in a tubular handle. The tubular handle includes a slot and a knob slideably engaged in the slot. The cable, running generally in a loop, is fixed at a proximal end portion to an interior portion of the knob and is further fixed at a distal end portion to a component of the push implement. One preferred implement is a snowthrower and a preferred component is a snow directional chute. The tubular handle is hinged and may be folded with the cable to its compact form for storage. Pulley wheels direct the cable from the tubular handle to the body of the push implement. In operation, a sliding of the cable by the knob to an infinite number of positions in turn permits a wide variety of options for the component. Operation of the sliding cable is easily accomplished, even while squeezing the elongate kill bar switch.

21 Claims, 2 Drawing Sheets

OPERATIONAL CONTROL MECHANISM

This application claims the benefit under Title 35, United States Code § 119(e) of the United States provisional application No. 60/018,047 filed May 21, 1996. Such provisional application No. 60/018,047 is hereby incorporated by reference in its entirety into this application.

FIELD OF THE INVENTION

The present invention relates generally to hand controls, particularly to operational hand controls, and specifically to operational hand controls for push implements.

BACKGROUND OF THE INVENTION

A push implement is an implement such as a snowthrower, lawnmower, or floor cleaner where the implement includes a frame, a handle on the frame for pushing the implement, a set of wheels, a power unit on the frame, and an apparatus on the frame for interacting with matter adjacent the ground or floor and being driven by the power unit, and control components on at least one of the power unit and apparatus. For the purposes herein, the meaning of push implement includes an implement that may be totally or partially self propelled and than may be merely guided or controlled by the operator. A power snow blower of power lawn mover is an example of such.

Push implements have variable components or features which are desirably adjusted quickly, even while the push implement is in motion. For example, a snowthrower includes a rotatable directional snowchute which may direct snow, thrown up the chute by the auger apparatus on the frame, in a number of outward directions. A homeowner may push his or her snowthrower down to the end of a driveway with the snow being directed by the chute away from the neighbor's driveway, then pivot the snowthrower 180°, rotate the chute, and continue back to his starting point with the rotated chute directing snow to the same side of the driveway. Further, a sidewalk may intersect the driveway, such as half-way down to the end of the driveway. With a chute which is adjustable even while the push implement is in motion, the operator may rotate the chute while pushing the snowthrower such that snow is thrown on either side of the sidewalk.

Push lawnmowers provide another example of a push implement having a variable component. For instance, the operator of a lawnmower may be approached by a number of persons, such as his or her spouse, children, or neighbors. However, a conversation may be difficult because of the noise of the lawnmower. With his or hand still squeezing the kill switch to maintain operation of the engine, the operator of the lawnmower may turn the throttle to cut the speed of the engine to decrease the noise of the engine to permit a conversation.

Indoor push implements such as floor cleaners include variable components which may be adjusted to a certain position over a range of positions. For example, with rotary floor cleaners, the rotary cleaning head may be lowered to a particular level to bring brushes into contact with the floor with a greater resilient force for a particular dirty area. For a portion of the floor which is less dirty, the cleaning head may be raised to its regular level.

SUMMARY OF THE INVENTION

A general object of the present invention is to provide a unique handle slide control for a push implement.

Another object of the invention is to provide a handle slide control which uniquely includes a cable sliding in a tubular handle. Specifically, the tubular handle includes a transversely oriented slot and a knob slideably engaged in the slot. The cable is formed generally in the shape of a loop and includes a proximal portion affixed to the knob and a distal portion engaged to a component of the push implement. Via the cable, a sliding of the knob actuates the component. The knob may be slid to an infinite number of positions, which permits a wide variety of options for control of the component.

Another object of the invention is to provide for a cable which is uniquely led through a hinged handle. Such permits the handle to fold up to its compact form for storage of the implement or for rendering the implement portable without a disconnection of the cable or any other part of the handle slide control from the implement.

Another object of the invention is to provide a slot which provides for travel of the knob over a relatively great distance so as to provide for adjustment of the component to a number of different positions. To provide for a relatively long slot, the slot is extended from the transverse portion of the handle into the curved portions of the handle and further into the longitudinal portions of the handle.

Another object of the invention is to uniquely relate the control to a cut or kill switch. The cut or kill switch is transversely oriented, and the slide control knob slides in a direction parallel to the kill switch to permit one hand at the same time to slide the knob and squeeze the cut or kill switch. It should be noted that the cut or kill switch is that which cuts or kills power or operation such as by activating or deactivating a component or engaging or disengaging two parts (i.e., a clutch). For example, with the "kill switch" of the present snow blower, the kill switch initiates an engagement of the auger when the kill switch handle is squeezed towards the slotted handle. Kill switch operation is activated when the kill switch handle is released—to fall downward and be drawn in toward the engine.

Another object of the invention is to provide for a unique smooth control of the sliding of the cable. Pulley wheels between the handle and the component permit a change in direction and a smooth sliding of the cable.

An advantage of the invention is that the component is adjustable to an infinite number of positions.

Another advantage is that the component is easily adjusted.

Another advantage is that the component is adjusted while the hand remains in position on the handle to permit the operator to guide the implement.

Another advantage is one hand operation at the same time of both the sliding knob and the kill switch.

Another advantage is that the handle slide control is simple and easy to install, operate and maintain.

Another advantage is that the handle slide control is inexpensive.

These and further objects and advantages of the present invention will become clearer in light of the following detailed description of the illustrative embodiments of this invention described in connection with the drawings.

BRIEF DESCRIPTION OF THE DRAWINGS

The illustrative embodiments may be best described by reference to the accompanying drawings where.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood. Where used in the various figures of the drawings, the same numerals designate the same or similar parts.

DESCRIPTION

Figure 1:
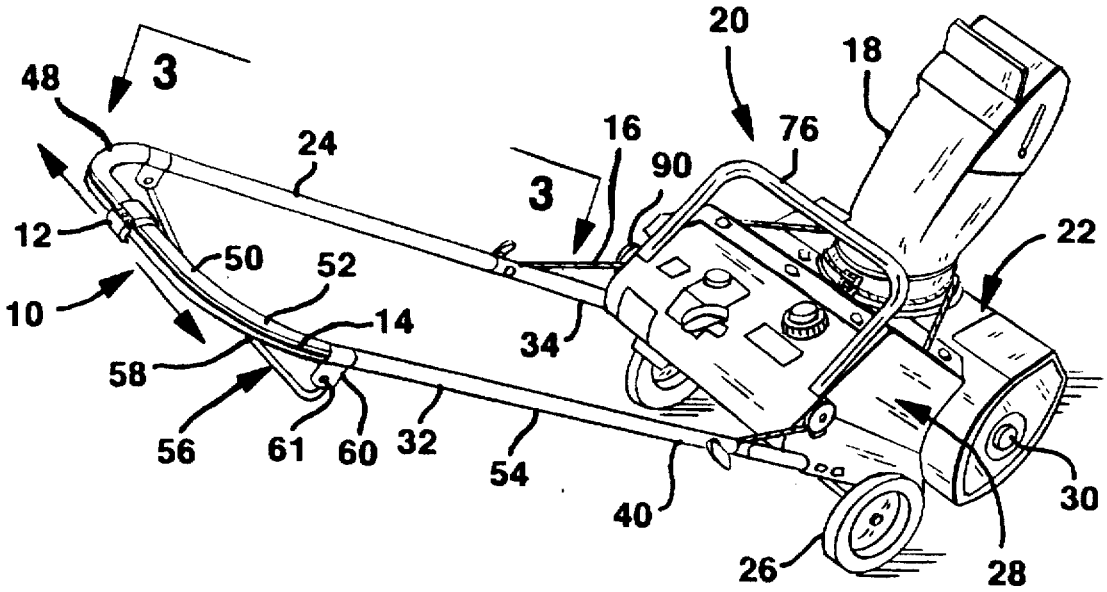
FIG. 1 is a perspective view of the handle slide control on a snowthrower implement.

As shown in FIG. 1, the present handle slide control is indicated in general by the reference numeral 10. The handle slide control 10 generally includes a knob or slide 12 which is slideably engaged in a slot 14. The knob or slide 12 is affixed to a cable 16 which is further affixed to a snow directional chute or implement component 18.

As further shown in FIG. 1, a push implement is indicated in general by the reference numeral 20. The push implement 20 is a snowthrower having a frame or housing 22, a handle 24 extending from the frame or housing 22 for pushing the snowthrower implement 20, a set of wheels 26, a power unit 28 fixed to the frame 22, and an auger apparatus 30 for throwing snow into and out of the snow directional chute 18.

Figure 2:
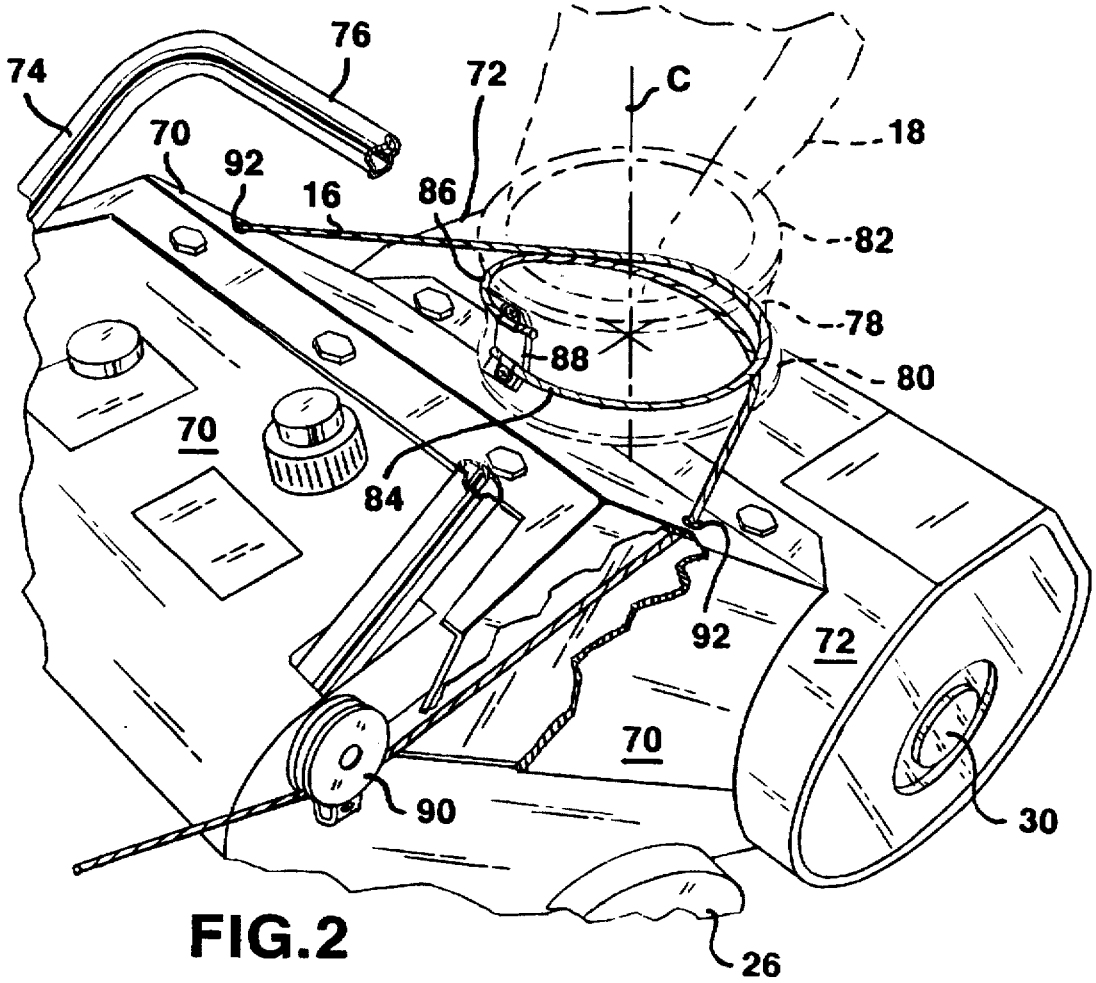
FIG. 2 is a detail view of the cable of the handle slide control of FIG. 1 engaging a rotatable snow directional chute of the snowthrower implement of FIG. 1, with the chute shown in phantom.
Figure 3:
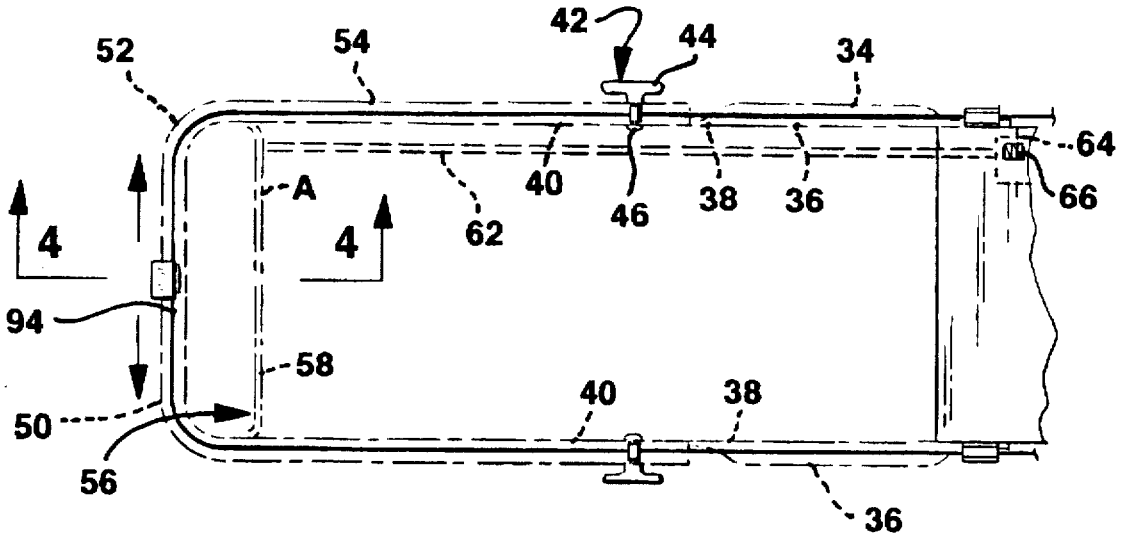
FIG. 3 is a plan view of the handle slide control of FIG. 1 at lines 3—3 of FIG. 1 showing the handle and kill switch of the snowthrower implement in phantom.

More specifically, the handle 24 includes a proximal U-shaped portion 32 hinged to a pair of distal portions or base portions 34 rigidly affixed to the frame or housing 22 of the push implement 20. As shown in FIGS. 2 and 3, each of the distal or base portions 34 includes a tubular section 36 fixed to the frame 22 and an integral coaxial curved bar 38 extending from the tubular section 36. Integral coaxial curved bar 38 lies on the outside cylindrical surface of distal tubular sections 40 of U-shaped portion 32 and is hingedly engaged thereto by a hinge 42. The hinge 42 includes a hand sized female threaded receptor or wing nut 44 cooperating with a threaded pin connector 46. A loosening of the hinge 42 permits a disengagement of each of the coaxial curved bars 38 relative to its respective tubular section 40 to in turn permit a folding of the U-shaped portion 32 inwardly and onto the frame or housing 22 of the push implement 20.

As shown in FIGS. 1 and 2, the handle 24 further includes a tubular grip portion 48. The grip portion 48 includes a generally linear tubular section 50 and a pair of curved tubular sections 52 running from either end of the linear section 50. The curved sections 52 still further lead into a pair of tubular longitudinal sections 54 which include the distal tubular sections 40. The tubular grip portion 48 includes the slot 14. The slot 14 is formed in both the linear and curved tubular sections 50, 52.

The handle 24 further includes a bail or cut or kill switch 56. The kill switch or bail 56 includes a kill rod 58 formed in a general U-shape and pivotally affixed on either end to brackets 60 which are rigidly affixed to the longitudinal sections 54 of the handle 24 at a position adjacent to the curved sections 52 of the grip portion 48. Such pivoting is accomplished through a pivot pin 61. The kill rod 58 is biased to return to a kill position designated by the reference character A in FIG. 3. The kill rod 58 is swingable or pivotable from the kill position A to an operating position B, shown in FIG. 4. In the operating position B the kill rod 58 lies generally under and adjacent to the linear section 50 and parallel to the linear section 50 such that the kill rod 58 may be squeezed at the same time with the same hand that slides the knob or slide 12 back and forth in the slot 14.

Figure 4:
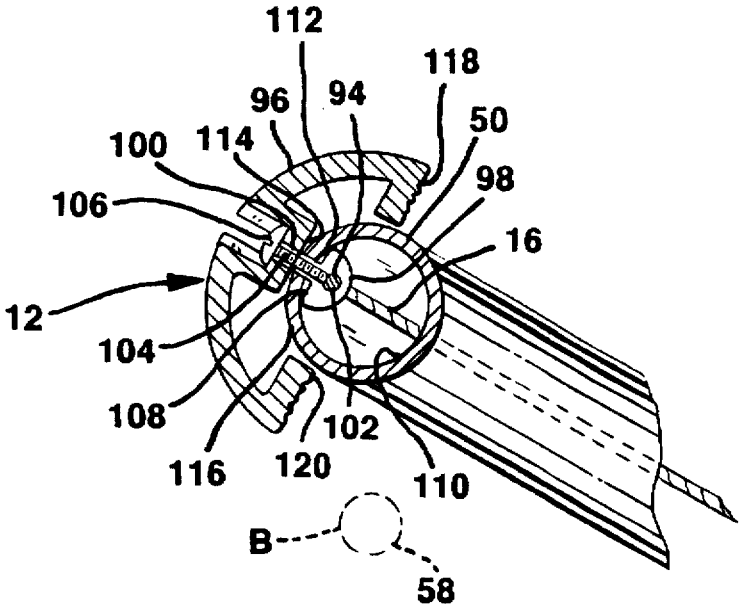
FIG. 4 is a detail section view of the handle slide control at lines 4—4 of FIG. 3.

The kill switch or bail 56 includes a cable 62 affixed thereto and running to a clutch mechanism 64 of the auger apparatus 30. Clutch mechanism 64 is shown schematically in FIG. 3. Squeezing the kill rod 58 so as to pivot the rod 58 to operating position 58 as shown in FIG. 4 permits the clutch mechanism to drive the auger of the auger apparatus 30. Releasing the rod 58 permits the rod 58 to return by a bias mechanism 66, such as a coil spring, to the cut or kill position A. Bias mechanism 66 is shown schematically in FIG. 3 and releases tension on a belt that drives the auger of the auger apparatus 30. The auger thus ceases to rotate and ceases to throw snow. Hence the bail or kill switch 56 in the snow thrower implement 20 kills rotation or driving of the auger. In other implements, such as a lawnmower, the kill switch or bail may kill operation of the power unit, i.e., the gas engine driving the cutting blade of the mower.

As shown in FIGS. 1 and 2, the power unit 28 includes a housing portion 70. The power unit 28 further includes a gas engine and gas tank. As further shown in FIG. 2, the auger apparatus 30 includes a housing portion 72. Still further shown in FIG. 2 is a lift bar 74 fixed to the power unit housing portion 70. Lift bar 74 is generally U-shaped and affixed such that a linear portion 76 of the bar 74 generally defines a center of gravity of the push implement 20 to ease a lifting of the push implement 20 such as out of deep wet compacted snow where the auger ceases to operate.

As shown in FIG. 2, the snow directional chute 18 is mounted on auger housing portion 72. The chute 18 includes a race portion 78. Race portion 78 is mounted on an internal sleeve fixed to auger housing portion 72 and rotates about such internal sleeve. Race portion 78 is concave and includes respective lower and upper annuli 80, 82.

The cable 16 includes distal end portions 84, 86 which are would about the race portion 78 in opposite directions and are rigidly fixed to the race portion 78 via a bracket 88. Cable 16 is led into the housing 22 or more specifically the power unit housing portion 70 via pulley wheels 90 rotatably engaged on either side of the power unit housing portion 70. From the pulley wheels 90, the cable 16 runs through the power unit housing portion 70 and subsequently exits through eyelet 92 formed in the front of the power unit housing portion 70, and then runs to the race portion 78.

As shown in FIG. 3, the cable 16 further includes a proximal portion 94 affixed to the knob 12. From the pulley wheels 90 to the proximal portion 94, the cable 16 runs into open ends of the tubular distal sections 40, about the pin connectors 46 of the hinge 42, through the tubular longitudinal sections 54, through the tubular curved sections 52, and through the tubular linear section 50. The handle 24 is foldable about the hinges 42 even with the flexible cable 16 running through the tubular longitudinal sections 54. The cable 16 forms a loop between the knob 12 and the snow directional chute 18.

As shown FIGS. 1 and 4, the knob 12 includes an exterior portion 96, an interior portion 98 and a neck 100 connecting the portions 96, 98. The interior portion 98 includes a transversely extending through hole 102 formed therein and through which the proximal portion 94 of the cable 16 extends. The neck 100 includes a threaded bore 104 formed therein and in communication with the through hole 102. A pin connector or set screw 106 is threaded in the hole 104 and includes a distal end for pinching the proximal portion 94 of the cable 16 against the wall of the through hole 102, which thus fixes the knob or slide 12 to the cable 16. It is preferred that the set screw 106 is locked to the cable 16 when the knob 12 is at the center of the tubular linear section 50 and when the discharge spout 18 is aligned straight forward.

The width of the neck 100 is slightly less than or about equal to the width of the slot 14 such that the neck 100 slides relatively easily in the slot 14 in the transverse or lateral direction with little play in the longitudinal direction. Further contributing to the minimal play in the longitudinal direction is the shape of the interior portion 98, which includes a pair of flat face portions 108. The flat face portions 108 confront an inside face 110 of the tubular grip portion 50 and terminate in edges 112 which ride on the inside face 110 on either side of the slot 16.

Besides minimizing longitudinal play of the knob or slide 12, the edges 112 minimize surface contact between the knob 12 and the tubular grip portion 50. Further minimizing surface contact between the knob 12 and the tubular grip portion 50 is the provision of a flat face portion 114 of the exterior portion 96 of the knob 12. The flat face portion 114 extends tangential to the outside surface 116 of the tubular grip portion 50 and hence minimizes surface contact therewith.

The head of the pin connector 106 is inset in the knob 12 so as to minimize a catching of the head on gloves or mittens or a cutting of the hand. Further, the exterior surface of the knob 12 is curved and the knob 12 may be less than or about equal to the length and width of a hand. The knob 12 further includes inwardly extending portions 118, the terminal ends 120 of which ride closely to the outside surface 116 of the tubular grip portion 50 to lend further stability to the knob 12 when such is at rest and when such is sliding.

In operation, the power unit of the snow thrower implement 20 is turned on. Then the slide 12 is slid by hand so as to direct the chute 18 in the desired direction. Then the kill or bail rod is squeezed so as to tension a belt in the clutch mechanism 66 so as to drive the auger apparatus 30, which in turn throws snow up and out of the chute 18. Engaging the auger apparatus 30 also tends to pull the snow blower forward and into the snow drift.

More specifically, when the slide or knob 12 is slid to or towards one side, the cable 16 is drawn so as to rotate the chute 18 about the axis C. It can be appreciated that sliding the slide 12 to the left rotates the chute 18 in the clockwise direction when looking down upon the chute 18. Sliding the slide 12 to the right rotates the chute 18 in the counterclockwise direction. The cable 16 pulls or draws the chute 18 to rotate in one direction by one of the cable distal sections and, at the same time, the other end of the cable distal section is equally unwrapped from the chute 18.

The cable 16 rides smoothly as it is drawn by the knob 12. Such is provided at least in part by the curved portions 52, or more specifically the inner curved surfaces thereof, the pulley wheels 90, and the bushings or grommets fixed in the entry and exit cable holes (eyelets) such as holes 92 formed in the power unit casing 70. Such smooth sliding is further provided in part by the minimal contact that knob 12 makes with the tubular grip portion 50.

It can be appreciated that the slide 12 travels a relatively great distance. Such maximizes the range of positions to which a component can be moved. Slide 12 travels both linearly and in a curved manner (along curved portions 52). Sliding of the slide or knob 12 is terminated at or near the brackets 60. However, the brackets 60 do not in themselves act as stops for the knob 12. Instead, built in tabs are provided between the auger housing portion 72 and the race portion 78 of the discharge chute 18. These tabs serve as stops for the rotation of the discharge chute 18 to prevent the discharge stream of snow from being thrown towards the operator of the snow blower. These metal tabs are located on the auger housing and a notch or opposing tabs on the base of the rotatable discharge spout 18 prevent the discharge spout 18 from rotating beyond the built in stops.

It should be noted that the length of the slot 14 is directly proportional to the circumference or diameter of the race portion 78. Accordingly, a discharge chute 18 of a shorter diameter relates to a slot 14 of a shorter length.

It should be noted that a sliding of the slide 12 produces movement of the chute 18 in an opposite direction. However, if desired, the cable distal sections 84, 86 may be wrapped oppositely of their present directions so as to associate sliding of the slide 12 to one side with rotation of the chute 18 to the same side.

Preferred components to be actuated by the cable 16 include those components which rotate about an axis, like the chute 18. However, other components, such as lever shaped components or components which pivot about an axis, may also be controlled by the cable 16. In such a case, the cable distal end sections may be affixed to the same end of the lever such that the cable equally pulls the lever and is drawn by the lever.

In summary, it can be appreciated that the one-eighth inch diameter flexible steel cable 16 is routed through the hollow steel tubing of the snow blower handle 24 through eyelets such as eyelets 92 and pulleys 90 and around a rotatable snow discharge chute 18. The cable 16 is a complete loop and is permanently affixed to the back side of the discharge chute 18 and is routed in both directions from the back of the chute around a race or channel 78 which encircles the base of the chute 18. It then continues around the base of the chute 18 to where it is led through eyelets and pulleys 90 into the lower ends of the foldable handle 24, and up through both sides of the handle 24 to the top of the handle 24 where the cable 18 is clamped to a knob 12 by which the snow blower operator can direct the discharge of snow without removal of his hands from the handle 24 and to continuously adjust the direction of discharge while continuing to advance the snow blower. The position of the clamp on the cable is transferred from the interior of the hollow handle 24 to the knob 12 on the exterior of the handle by set screws 106 that slide through a longitudinal slot in the outer perimeter of the handle 24. This transfer of the motion to the cable 16 on the interior of the handle 24 to the knob 12 on the exterior of the handle 24 through the slotted handle 24 provides the advantages of simplicity, ease of operation, and convenience.

The present handle slide control is preferably utilized in combination with push implements. However, it may be used in combination with other implements such as with riding implements. A riding lawn mower is an example of such.

Thus since the invention disclosed herein may be embodied in other specific forms without departing from the spirit or general characteristics thereof; some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A handle slide control in combination with an implement, with the combination comprising:

a) the implement which comprises a frame, a handle engaged with the frame, a set of wheels engaged with the frame for permitting the implement to ride over the ground, a power unit on the frame, an apparatus on the frame for interacting with matter adjacent the ground and being driven by the power unit, and control components on at least one of the power unit and apparatus for controlling features thereof, with the handle being oriented in a transverse direction to a forwardly direction of travel of the implement; and b) the handle slide control which comprises a knob slideably engaged on the handle and a flexible cable engaged to and between the knob and one of the control components, with the knob being slideable in the transverse direction such that a cable portion engaged to the knob is moved in the transverse direction to in turn move a cable portion engaged to the control component.

2. The combination of claim 1 wherein the handle includes a pair of elongate generally longitudinal portions and a grip transverse portion, with each of the elongate generally longitudinal portions comprising proximal and distal sections, with the transverse grip portion extending transversely between the proximal sections and with the distal sections engaging the frame, with each of the proximal sections and grip transverse portion including an interior, with the interiors being in communication with each other, and wherein the cable extends through at least an elongate portion of each of the interiors whereby the cable is disposed in an out-of-the way position.

3. The combination of claim 2 wherein the longitudinal portions are foldable about a transversely extending axis, with the longitudinal portions when folded in turn folding the flexible cable.

4. The combination of claim 2 wherein each of the longitudinal portions includes a hinged portion between their respective proximal and distal sections, and with the cable extending through each such hinge portion.

5. The combination of claim 2 wherein the grip transverse portion is tubular.

6. The combination of claim 2 wherein one of the proximal and distal sections of the longitudinally extending portions is tubular.

7. The combination of claim 2 and further comprising a kill switch pivotally affixed to the handle and biased to pivot away from the handle to a kill position where a component is deactivated, with the kill switch being elongate and extending in the transverse direction, with the kill switch being pivotable to a position adjacent to the handle slide control the component is activated, and with the handle slide control and the kill switch running generally parallel to each other such that the kill switch may be squeezed where the handle slide control is slid.

8. The combination of claim 1 wherein the cable forms generally a loop between the knob and said one control component.

9. The combination of claim 1 wherein the apparatus comprises a snowthrowing apparatus and wherein the component comprises a snow directional chute for directing snow outwardly from the implement, with the snow directional chute having at least two positions and being movable between such two positions, with the chute when in the first position directing snow in a direction different from when the chute is in the second position, with the cable engaged to the chute and moving the chute to and between the first and second positions when the knob is slid in the transverse direction.

10. The combination of claim 9 wherein the snow directional chute is rotatable and wherein the chute is rotated when the knob is moved in the transverse direction.

11. The combination of claim 10 wherein the chute is rotated about an axis extending in an upward direction from the ground.

12. The combination of claim 9 wherein the chute may be positioned at an infinite number of positions between the first and second positions, and wherein the knob may be slid to an infinite number of positions.

13. A handle slide control for an implement, with the implement comprising a frame, a handle engaged with the frame, a set of wheels engaged with the frame for permitting the implement to ride over the ground, a power unit on the frame, an apparatus on the frame for interacting with matter adjacent the ground and being driven by the power unit, and a control component on at least one of the power unit and apparatus for controlling a feature thereof, with the handle having a transverse portion being oriented in a transverse direction to a direction of travel of the implement, with the handle slide control comprising:

a slideable knob on the transverse portion of the handle and a flexible cable engaged to and between the knob and one of the control components, with the knob being slideable in the transverse direction such that a cable portion engaged to the knob is moved in the transverse direction and such that a cable portion engaged to the control component actuates the control component to in turn control a feature of one of the power unit and apparatus.

14. The handle slide control of claim 13 wherein the transverse portion of the handle is tubular and includes a slot and wherein the cable runs through the transverse portion of the handle, with the knob comprising an inner portion sliding in the transverse portion and fixedly engaged to the cable, a neck portion extending through the slot, and an outer portion for engagement by a hand.

15. The handle slide control of claim 13 wherein the knob is slideable on the transverse portion of the handle to and between first and second positions and wherein the control component may be moved via the knob and cable to first and second locations, with the first position corresponding to the first location and with the second position corresponding to the second location.

16. The handle slide control of claim 13 wherein the knob is slideable on the transverse portion of the handle to an infinite number of positions between the first and second positions and wherein the control component may be moved via the knob and cable to an infinite number of locations between the first and second locations, with each of the infinite number of positions corresponding to each of the infinite number of locations.

17. The handle slide control of claim 13 wherein the handle further comprises a pair of curved portions, with the curved portions being tubular and being integral with the transverse portion, and with the slot extending into the curved portions such that the knob is slideable to and between the transverse and curved portions such that travel of the knob is extended into the curved portions.

18. The handle slide control of claim 13 wherein the handle further comprises a kill switch pivotally affixed to the handle and biased to pivot away from the handle to a kill position where operation of at least one of the power unit and apparatus is killed, with the kill switch being elongate and extending in the transverse direction, with the kill switch being pivotable to a position adjacent to the handle slide control where such operation is permitted, and with the handle slide control and the kill switch running generally parallel to each other such that the kill switch may be squeezed where the handle slide control is slid.

19. The handle slide control of claim 13 wherein the apparatus includes an auger, wherein operation of the auger is killed when the kill switch pivots away from the handle, and wherein operation of the auger is permitted when the kill switch pivots to the position adjacent to the handle slide control.

20. The handle slide control of claim 13 wherein the cable includes a bend between the transverse portion and the control component, and further comprising a pulley wheel engaged to the frame and engaging the cable about the bend such that movement of the cable is facilitated.

21. A handle slide control in combination an implement, with the implement having one or more components which may be activated and deactivated, with the handle slide control comprising:

a) a handle extending from the implement, with the handle including a distal hand grip portion;

b) a slot formed in at least a section of the hand grip portion;

c) a knob slidingly engaged in the slot in a transverse direction to a forwardly direction of travel of the implement and having exterior and interior portions;

d) a kill switch pivotally affixed to the handle and biased to pivot away from the hand grip portion to a kill position where at least one of the components is deactivated, with the kill switch being elongate and extending in the transverse direction, with the kill switch being pivotable to an operating position adjacent to the hand grip portion where said one or more of the components is activated, and with the hand grip portion and the kill switch running generally parallel to each other such that the kill switch may be squeezed with the hand sliding the knob; and e) a flexible cable running through the hand grip portion, with the flexible cable being fixedly engaged to the interior portion of the knob and further being engaged to at least one of the components of the implement such that a sliding of the knob in the slot slides the cable in the hand grip portion to in turn actuate said at least one component.

* * * * *